US005836626A

United States Patent [19]

Coy

[11] Patent Number: 5,836,626

[45] Date of Patent: Nov. 17, 1998

[54] LOCKING DOOR LATCH

[76] Inventor: Thomas A. Coy, 621 Allen Ave., Glendale, Calif. 91201

[21] Appl. No.: 638,653

[22] Filed: Apr. 29, 1996

[51] Int. Cl.[6] ..... E05C 19/18

[52] U.S. Cl. ..... 292/292; 292/289; 292/295

[58] Field of Search ..... 292/288, 292, 292/289, 291, 293, 295, DIG. 37, 294, 290, 266, 265

[56] References Cited

U.S. PATENT DOCUMENTS

| | | | |
|---|---|---|---|
| 452,947 | 5/1891 | Morris | 292/290 |
| 553,496 | 1/1896 | Caminetti | 292/295 |
| 614,052 | 11/1898 | Jackson | 292/295 |
| 781,501 | 1/1905 | Dobson | 292/292 |
| 801,369 | 10/1905 | Dickson | 292/295 |
| 1,150,621 | 8/1915 | Prante | 292/294 |
| 1,266,689 | 5/1918 | Kinghorn | 292/295 |
| 1,579,298 | 4/1926 | Fry et al. | 292/296 X |
| 1,947,773 | 2/1934 | Haviland | 292/292 |
| 2,461,398 | 2/1949 | Sands | 292/290 X |
| 2,588,077 | 3/1952 | Beadle | 292/295 |
| 3,563,593 | 2/1971 | Leier | 292/296 |
| 3,913,962 | 10/1975 | Briggs | 292/292 |
| 4,169,619 | 10/1979 | McCracken | 292/290 |
| 4,254,976 | 3/1981 | Shoberg | 292/292 |
| 4,471,981 | 9/1984 | Wright | 292/292 |
| 4,603,895 | 8/1986 | Langenbahn | 292/292 X |
| 4,878,701 | 11/1989 | Rondel et al. | 292/292 X |
| 5,221,116 | 6/1993 | Lan | 292/291 |
| 5,325,685 | 7/1994 | Frank | 292/292 X |
| 5,401,068 | 3/1995 | Barnard | 292/289 |

FOREIGN PATENT DOCUMENTS

| | | | |
|---|---|---|---|
| 538418 | 11/1931 | Germany | 292/266 |

*Primary Examiner*—Steven Meyers
*Assistant Examiner*—Tuyet Pham
*Attorney, Agent, or Firm*—Fulwider, Patton, Lee & Utecht, LLP

[57] ABSTRACT

A door latch is disclosed herein for use in cooperation with a door jamb striker plate and a door closure sliding latch which includes an elongated latch plate having a pair of lateral spaced-apart arcuate projections insertable into the opening of the striker plate so that the latch plate outwardly extends behind the door normal thereto. A notched slot is formed along the midsection of the latch plate and a securement block is slidably carried on the latch plate having a front surface adapted to butt against the adjacent edge marginal regions of the door and door jamb. The securement block includes a manually operated plunger mechanism for releasable engagement with selected ones of the notches in the slot to maintain the block in abutment with the door and door jamb.

12 Claims, 3 Drawing Sheets

LOCKING DOOR LATCH

BACKGROUND OF THE INVENTION

1. Field of the Invention

The present invention relates to the field of door locks, and more particularly to a novel locking door latch which is used in cooperation with existing striker plate and movable latch normally carried on the door jamb and door of a conventional door lock set.

2. Brief Description of the Prior Art

In the past, it has been the conventional practice to employ a releasable door latch for releasably securing the edge marginal region of a swingable door to the edge marginal region of a door jamb via a movable bolt which is insertably received into the opening of a striker plate carried on the door jamb. In addition to this conventional manner of securing a door to a door jamb, a variety of chains, links and other mechanisms have been employed for securing the door to the door jamb in addition to the conventional door lock set. Some attempts have been made to use an auxiliary door latch which includes a flanged plate engageable with the striker plate prior to the closing of the door. When the door is closed, a blocking member is moved on the plate so as to engage with the door and when secured in this position, assists in preventing the door from being forced open. Such a representative device is disclosed in U.S. Pat. No. 4,072,333, as well as in U.S. Pat. No. 3,596,961.

Although these prior devices have been successful in temporarily securing a door to the door jamb, problems and difficulties have been encountered, which stem largely from the fact that in some of the devices, notches or teeth are provided on the upper and lower edge marginal regions of the plate so that the rough edges and elements separating the notches cause injury to the hand of the user as he installs the device. In other instances, the flanges which are engaged with the striker plate do not properly permit the conventional bolt from the standard doorset from fully entering the opening in the striker plate so that its effectiveness for securement is lost. Furthermore, some prior devices are not readily operated by a single hand of the user and in other instances, the mechanism for releasably securing the blocking member on the plate is complex and not cost effective.

Therefore, a long-standing need has existed to provide a novel locking latch device for releasably securing the edge marginal region of a swingable door to a stationary door frame or jamb that may be easily installed and readily disassembled after use and yet which is effective to secure the door to the door frame or jamb in order to prevent or deter forced entry.

SUMMARY OF THE INVENTION

Accordingly, the above problems and difficulties are obviated by the present invention which provides a novel lockable latching device which includes an elongated latch plate having a pair of spaced-apart and arcuate flanges or projections outwardly extending from one side of the plate. The flanges or projections are semicircular in cross-section so as to slidably receive the standard bolt or latch which is provided on a swingable door in a conventional manner. The latch plate further includes an elongated slot formed with a plurality of internally opening notches extending across the middle of the plate between its opposite ends. A blocking member or securement block is slidably carried on the plate and includes a releasable latch mechanism for selectively engaging with selected ones of the internal notches so that the securement block may be forced into abutting engagement with the edge marginal regions of the door jamb and the door regardless of jamb or door thickness. The releasably mechanism includes a spring-biased plunger which includes a retaining pin normally biased into engagement with a selected notch of the plurality.

Therefore, it is among the primary objects of the present invention to provide a novel locking door latch which may be used to prevent forcible entry through a swingable door when the door is in its closed position and the latch mechanism is retained so as to prevent opening of the door with respect to the door frame or jamb.

Another object of the present invention is to provide a novel and inexpensive door latching means which includes a plate fixed to the door jamb via the striker plate and further includes a securement means adapted to be moved by the user into a locking position to prevent the door from being forced open.

Yet another object of the present invention is to provide a novel door latch means which includes a plate and sliding securement member installable with a conventional striker plate on the door jamb and which provides smooth and regular surfaces so as to prevent injury to the user or damage to clothing or other materials.

Still a further object of the present invention is to provide a novel temporary door securement means which includes a pair of spaced-apart flanges insertable into the opening of a striker plate which will not encumber nor prevent insertion of the normal bolt or latch from a conventional doorset from entering the striker plate opening.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
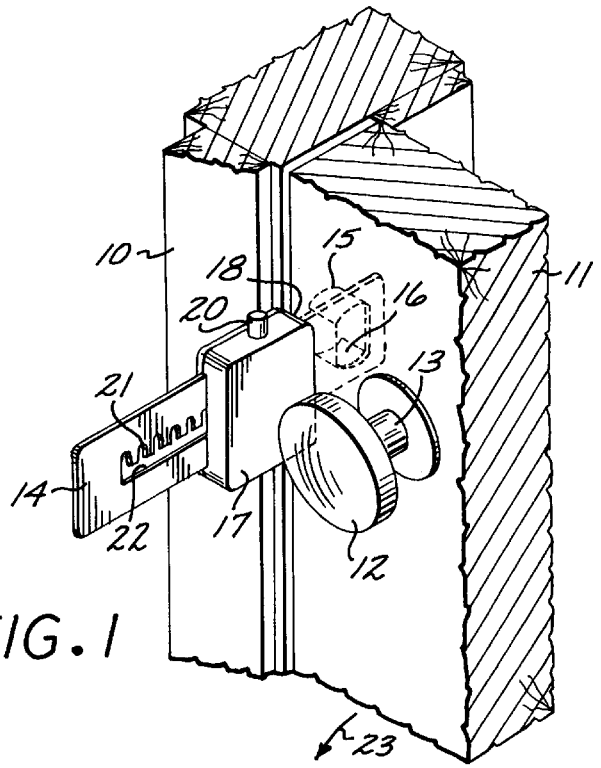
FIG. 1 is a front perspective view of a conventional door jamb or frame and swingable door utilizing the locking door latch means of the present invention.

Referring to FIG. 1, a conventional door jamb or frame is indicated by numeral 10 and is considered to be stationary or nonmovable. A conventional door is indicated by numeral 11 which is intended to swing between an open position (not shown) and a closed position, as shown in the FIGURE. As is the usual practice with conventional doors, a standard doorset is included which comprises an inner door knob 12 having a rotatable shaft 13 to which is attached a sliding bolt or latch (not shown) having a cantilevered end which is insertably received through the opening of a striker plate carried on the stationary door jamb 10. The striker plate is of conventional design which includes a flat plate having an enlarged opening which is secured to the face of the door jamb in alignment with the bolt actuated by the turning of the knob 12.

In accordance with the present invention, the latch device includes an elongated plate 14 which when installed, extends normal to the edge marginal region of the door 11 which faces the door jamb and its striker plate, as indicated by numeral 10. Initially, the door 11 is in its open position and a pair of spaced-apart arcuate flanges or projections 15 and 16 are insertably received through the striker plate opening and the plate 14 is moved about the door jamb 11 to permit closure of the door 11. The thickness of the latch plate 14 occupies the space between the facing of the door 11 with the door jamb 10. To secure the door 11 and prevent forcible opening and unauthorized entry, a securement block or member 17 is manually slid along the plate 14 so that its front surface, indicated by numeral 18, will abut and bear against the edge marginal region of the inside surface of door 11 and the door jamb 10. The thickness of the securement member 17 is such that the member will extend across the space between the face of the door 11 and the door jamb 10 so that the securement member bears against both structural elements. In order to permit sliding of the securement member 17 along the latch plate 14, a pushbutton 20 is employed for releasably connecting the member 17 with a plurality of notches, such as notch 21, provided along an internal slot 22. Therefore, it can be seen from FIG. 1 that the door 11 cannot be swung open, as indicated by the arrow 23, since the edge of the door is blocked from moving by the presence of the securement member 17 bearing against the inside surface of the edge marginal portion of the door 11.

Figure 2:
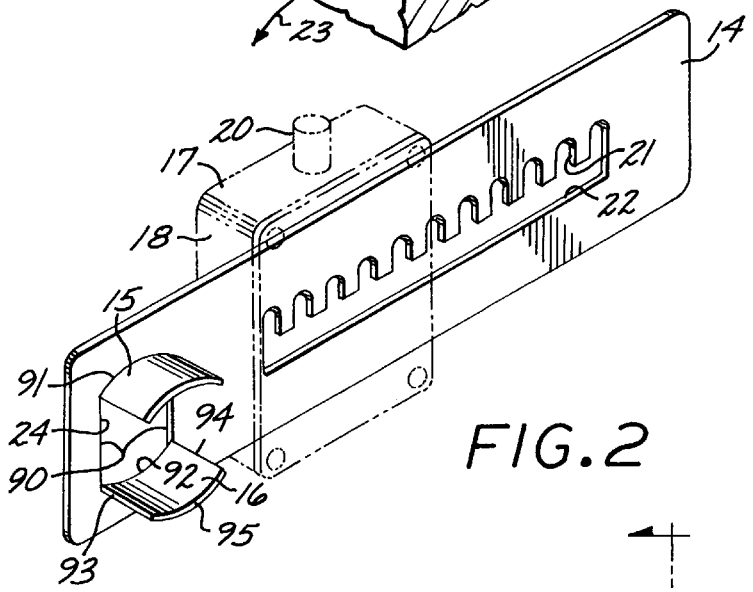
FIG. 2 is an enlarged perspective view of the lockable door latch means shown in FIG. 1.
Figure 3:
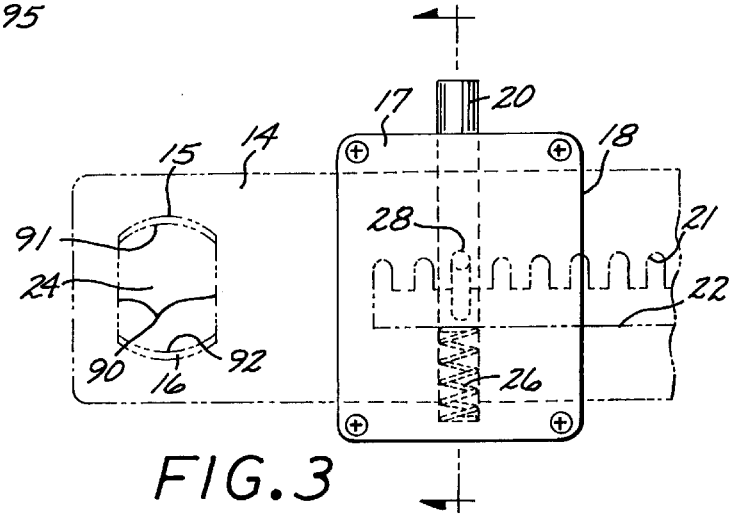
FIG. 3 is a front elevational view of the securement block slidably carried on a latch plate as illustrated in FIG. 2.

Referring now in detail to FIGS. 2 and 3, the latch plate 14 is more clearly illustrated in which it can be seen that the slot 22 is elongated and formed along the midsection of the plate between its upper and lower edges and further extending between the opposite ends of the plate. A selected end of the plate includes the laterally extending flanges or projections 15 and 16 and it is to be particularly noted that these flanges are semicircular in cross-section so as is formed with opposed vertical edges 90, curved top edge 91, and curved bottom edge 92, and to readily accommodate the insertion of a conventional bolt from a door latch set as the bolt is inserted through the opening 24. The flanges or projections 15 and 16 may be formed, as shown in FIG. 3, with forward lateral edge 93 and rearward lateral edge 94, both lateral edges projecting from latch plate 14 and terminating at stop edge 95. It is to be borne in mind that the opening 24 is in registry or alignment with the opening on the conventional striker plate and that the opposite edges of the flanges or projections 15 and 16 also bear against the strike plate edges defining the opening therein so as to offer resistance to dislodgement should an attempt be made to force door 11 into its open position. It is also to be noted in FIG. 2 that the notches or row of teeth forming the notches are internal as well as the slot 22. The top and bottom edges of the plate are smooth and will not damage clothing, fabric or cause injury to the user's hand. The securement member 17 is illustrated in dotted lines only to more clearly reveal the linear arrangement of the notches on the interior of the plate 14.

Figure 4:
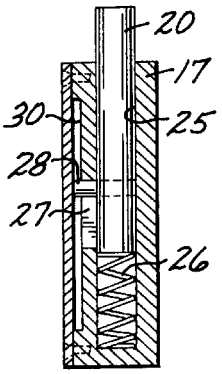
FIG. 4 is a transverse cross-sectional view of the securement block shown in FIG. 3 as taken in the direction of arrows 4—4 thereof.

Referring now in detail to FIGS. 3 and 4, it can be seen that the securement body 17 includes a plunger 20 that is reciprocally movable through an internal bore 25 and that the plunger is normally biased outwardly by means of a helical spring 26. One end of the spring bears against the bottom of the bore while the other end of the spring presses against the underside of the plunger 20. The securement member 17 further includes an elongated opening 27 through which a pin 28 projects so that the pin serves as a stop means for limiting the upward movement of the plunger when the pin engages with the end of the opening 27. Downward displacement of the plunger is stopped when the retaining pin 28 bears against the other end of the opening 27. Also, the securement member 17 further includes an open-ended cavity 30 which extends between its front and rear surfaces for accommodating the thickness of the latch plate 14. Also, the retaining pin 28 extends into the cavity 30 and permits the securement member 17 to slide along the length of the plate 14 when the securement pin is depressed into alignment or registry with the elongated slot 22. However, when the front face 18 of the securement member is in abutment with the door 11, the plunger 20 can be released so that the normal bias of the spring 26 will cause the plunger to raise and the retaining pin 28 will leave the slot 22 and enter a selected one of the notches 21. As illustrated in FIG. 3, the retaining pin 28 is fully inserted into the third notch from the end of the slot 22 and the securement member 17 is fixed in this position until released.

Figure 5:
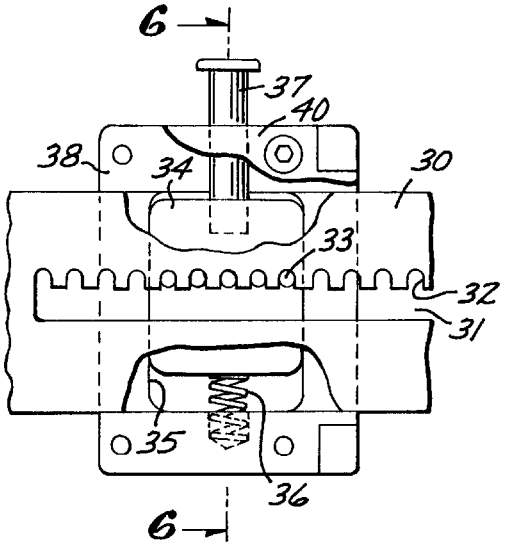
FIG. 5 is a front elevational view of the abutment housing showing an alternative embodiment which includes a plurality of retaining pins on the retainer.
Figure 6:
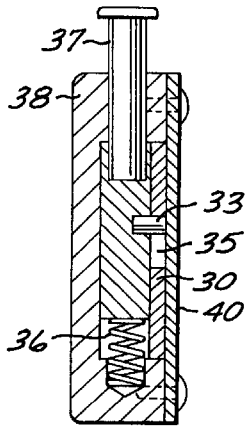
FIG. 6 is a transverse cross-sectional view of the abutment housing shown in FIG. 5 as taken in the direction of arrows 6—6 thereof.

Referring now to FIGS. 5 and 6, another embodiment of the present invention is illustrated wherein a latch or bar or plate is employed and is identified by numeral 30. The The latch plate 30 includes a slot 31 and a plurality of notches 32 into which a plurality of pins, such as pin 33, is selectively inserted. The plurality of pins 33 are carried on the side of an element 34 that is slidably carried in a recess 35. A spring 36 similar to the spring 26 forcibly urges the element 35 upwardly so that a pushbutton 37 is exposed exteriorly of a housing 38. The recess 35 is provided in the housing and the plate 40 covers the recess and a portion of the latch plate 30. This holds the element 35 in the recess as well as the pushbutton 37. Therefore, by providing a plurality of pins 33 rather than a single pin, as shown in FIGS. 2–3 inclusive, a firmer and more positive engagement ensues in order to lock the slider or securement element 38 to the latch plate 30. The holding power is increased substantially and greater difficulty is encountered for unauthorized detachment of the pins with the notches in the latch plate.

Figure 8:
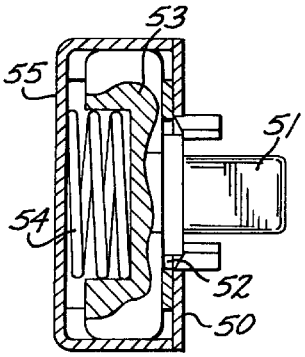
FIG. 8 is a transverse cross-sectional view of the alternative embodiment shown in FIG. 7 as taken in the direction of arrows 8—8 thereof.
Figure 7:
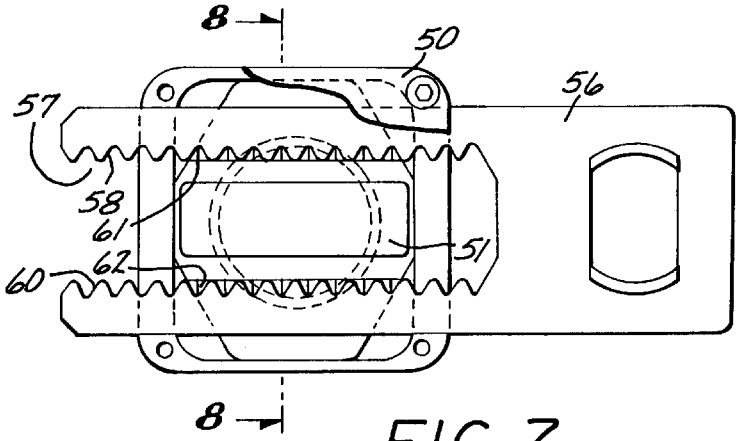
FIG. 7 is a front elevational view of an alternative embodiment of the invention in which a lateral pushbutton is used to disengage the retainer from the plurality of notches, and the internal slot is open-ended.
Figure 9:
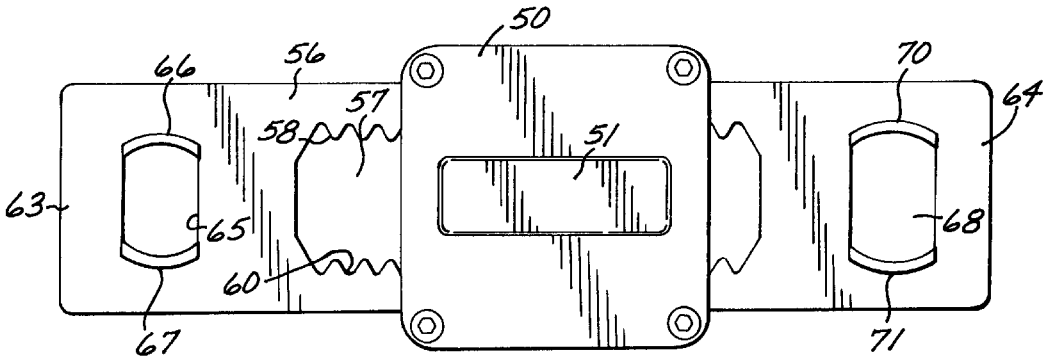
FIG. 9 is a front elevational view of another embodiment of the present invention in which two bolt pass-through holes of differing sizes are provided.

Referring now in detail to FIGS. 7, 8 and 9, another embodiment of the present invention is illustrated wherein the securement member is identified by numeral 50 and the member includes a laterally extending pushbutton 51 that projects outwardly through an opening 52. The pushbutton 51 is carried on an element 53 which is resiliently biased by means of spring 54 which bears against the bottom of case 55 and the opposing side of the element 53. A receptacle is provided in element 53 to accommodate the spring. As shown more clearly in FIG. 7, the latch plate 56 includes an open-ended slot 57 having a plurality of open notches communicating with the slot. An upper row of notches is illustrated by numeral 58 while a lower row of notches is illustrated by numeral 60. Insertably received simultaneously in the upper and lower row of slots, there is provided an upper and lower row of teeth or pins, such as identified by numerals 61 and 62 respectively. These rows of teeth or pins are carried on the side of element 53 and project into the slot 57 so as to be self-aligning with the respective notches.

Referring to FIG. 9, it can be seen that the latch plate 56 has opposite ends and constitutes a different embodiment in that both ends of the latch plate and the slot 57 are closed by portions 63 and 64 respectively. Each of these respective portions includes a bolt receiving aperture 65 defined between laterally extending arcuate flanges 66 and 67 and a bolt opening 68 through the portion 64 defined between arcuate flanges 70 and 71. The openings 65 and 68 are of different sizes so as to accommodate different sizes of bolts.

Therefore, it can be seen by depressing the laterally facing pushbutton 51 against the expansion of spring 54, the element 53 may be moved along the latch plate 56 so that the respective teeth 61 and 62 may be aligned with any particular plurality of notches 58 and 60 respectively. The slot 57 is open in the latch plate 56, as shown in FIG. 7, so that the slider 50 may be readily removed from the latch plate. In FIG. 9, door bolt openings 65 and 68 are of different sizes to accommodate different sized bolts.

Figure 10:
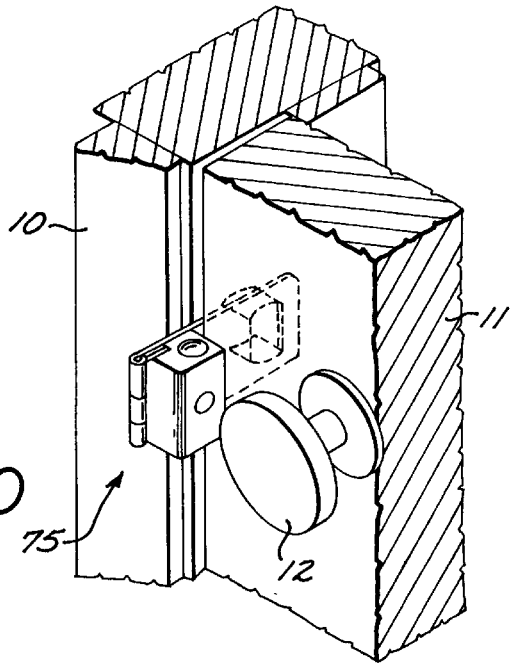
FIG. 10 is a front perspective view of a conventional door jamb or frame and swingable door utilizing another embodiment of the present invention in which the abutment housing is pivotally attached to the latch plate.
Figure 11:
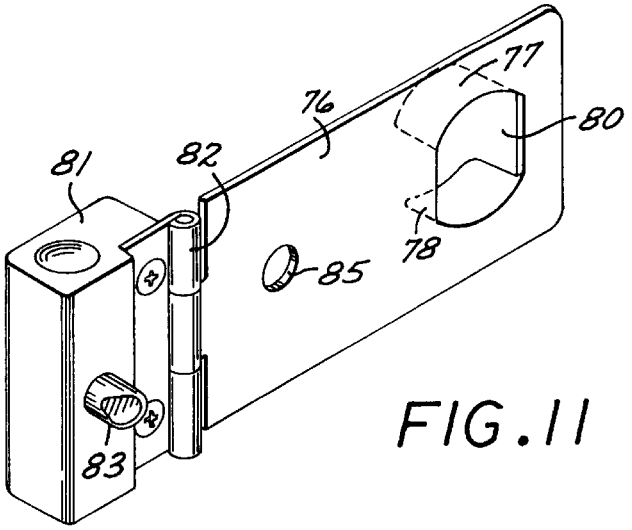
FIG. 11 is a perspective view of the embodiment shown in FIG. 10.
Figure 12:
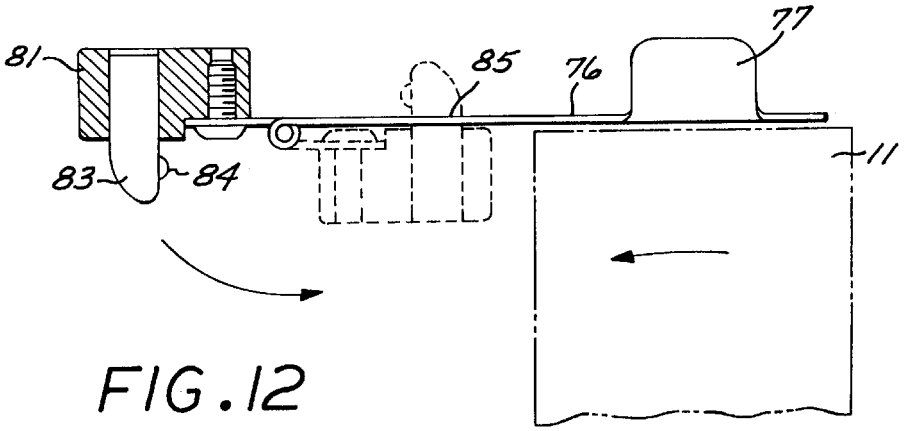
FIG. 12 is a top view of the embodiment shown in FIGS. 10 and 11 in which the open and closed positions and pivoting motion of the pivotally-attached abutment housing are shown.

Referring now in detail to FIGS. 10, 11 and 12, another embodiment of the present invention is illustrated wherein the latch plate 76 includes arcuate flanges 77 and 78 as previously described with respect to the earlier embodiments so that the bolt of the door mechanism will pass through an opening 80 between the flanges. Instead of having a slider securement member 17 or 37 or 50, the embodiment shown in FIGS. 10–12 include a pivoting securement member identified by numeral 81. The member 81 is pivotally attached to one end of latch plate 76 by means of a hinge 82 and the member further includes a lateral extending element 83 which includes a spring detent 84. When the member 81 is pivoted in the direction of the arrow shown in FIG. 12 to the position shown in dotted lines, the laterally projecting element 83 passes through an opening 85 in the latch plate 76. When the detent 84 yieldably passes through the aperture, it will expand on the opposite side from the member 81 and releasably hold the member 81 in the position shown in broken lines. Therefore, should the door 11 be forced towards the inside of a room, the face of the door will engage with the member 81 and be prevented from opening since the member 81 will interfere with forced opening of the door. When it is desired to permit opening of the door, the member 81 is pivoted to the position shown in solid lines in FIG. 12 and the door can now be readily opened. The flanges 77 and 78 are inserted into the striker plate and bolt opening of the door jamb 11, as previously described with respect to the other embodiments.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A locking door latch device for insertion between the free edge of a door to engage a horizontally-disposed retractable door bolt, to be received in a bolt hole formed in a mating door frame or jamb, and comprising:

an elongated, planar latch plate including at least one vertically-elongated bolt pass-through hole, said bolt pass-through hole having opposed straight vertical edges and curved top and bottom ends configured to be complementally received around said retractable bolt, said latch plate also including an internal longitudinal slot formed with two opposing longitudinal edges, one such edge being linear and the opposite being configured with a plurality of lateral notches spaced at selected intervals;

at least one arcuate flange segment projecting laterally from at least one of said ends of said at least one bolt pass-through hole and extending lengthwise on said latch plate to terminate in forward and rearward ends, said arcuate flange segment configured to complementally engage said bolt and be received in said bolt hole;

an abutment housing movably carried on said latch plate, and formed with an abutment side, said housing being shiftable to an abutting position disposing said abutment side for engagement with said door adjacent to said free edge;

a retainer plunger carried on said abutment housing selectively projectable from said abutment housing and having at least one retaining pin operative to, when said plunger is projected, engage a selected one of said plurality of notches; and a spring in said abutment housing biasing said plunger to said projected position.

2. The locking door latch device of claim 1, wherein:

said latch plate includes a second arcuate flange segment, projecting laterally from other of said at least one of said ends of said bolt pass-through hole, said arcuate flange segments opposing each other and separated by a distance defined by the length of said vertical edges.

3. The locking door latch device of claim 1, wherein:

said arcuate flange segment includes two parallel lateral edges, defined by said forward and rearward ends projecting 90 degrees from the plane of said latch plate; and said arcuate flange segment further comprises a stop edge, lying in a plane parallel to the plane of said latch plate and at 90 degrees to both of said two parallel lateral edges.

4. The locking door latch device of claim 1, wherein:

said retaining means further comprises a pin plate attached to said plunger and adapted to carry a plurality of retaining pins; and said plurality of retaining pins are arranged in a straight line parallel to said longitudinal slot and spaced at intervals conforming to said selected intervals of said plurality of notches, and are simultaneously engageable with a selected subset of said plurality of notches.

5. A locking door latch device for insertion along the free edge of a door to engage both a horizontally-disposed retractable door bolt received in a bolt hole formed in a mating door frame or jamb and the interior side of said door, said device comprising:

an elongated latch plate having at least one bolt pass-through hole defined, at least in part, by a peripheral edge and configured for projecting along the said free edge to confront said bolt hole and to receive said retractable bolt and including an internal longitudinal slot having two opposing longitudinal edges, one defining a straight longitudinal edge and the other formed with a plurality of notches spaced at selected intervals;

at least one flange segment projecting laterally from said peripheral edge to project around a portion of the periphery of said bolt and into said bolt hole;

an abutment housing movably carried on said latch plate, and formed with an abutment side, said abutment housing being shiftable to an abutting position disposing said abutment side for engagement with said door adjacent to said free edge; and a retainer carried on said abutment housing including a plunger projectable to a projected position and including at least one retaining pin operative to, when said plunger is in said projected position, engage a selected one of said plurality of notches and a spring releasably biasing said plunger to said projecting position.

6. The locking door latch device of claim 5, wherein:

said latch plate includes a second flange segment spaced from the first flange segment and projecting laterally from said latch plate for projecting about another portion of the periphery of said retractable bolt and into said bolt hole.

7. The locking door latch device of claim 6, wherein:

said flange segments are disposed on opposite sides of said bolt pass-through hole.

8. The locking door latch device of claim 7, wherein:

said flange segments are formed with respective forward and rearward edges projecting laterally from said plate.

9. The locking door latch device of claim 8, wherein:

said latch plate is formed to define said bolt pass-through hole with said peripheral edge defining oppositely-disposed front and rear vertical peripheral edges spaced a selected distance apart; and said flange segments are configured with the respective said front and rear edges disposed flush with the respective front and rear vertical peripheral edges.

10. The locking door latch device of claim 5, wherein:

said flange segment projects longitudinally of said plate and includes two parallel lateral edges projecting 90 degrees from the plane of said latch plate.

11. The locking door latch device of claim 5, wherein:

said retainer further comprises a pin plate attached to said plunger and adapted to carry a plurality of retaining pins; and said plurality of retaining pins are arranged in a straight line parallel to said longitudinal slot and spaced at intervals conforming to said selected intervals of said plurality of notches, and are simultaneously engageable with a selected subset of said plurality of notches.

12. A locking door latch device to engage a horizontally-disposed retractable door bolt having curved top and bottom sides projecting from the free edge of a door, said door bolt to be received in a bolt hole formed in a mating door frame or jamb, said device comprising:

an elongated latch plate including at least one vertically-elongated bolt pass-through hole, said bolt pass-through hole having curved top and bottom ends configured for complemental receipt around said door bolt, said plate further including a longitudinal adjustment slot;

at least one arcuate flange segment projecting laterally from at least one of said curved ends of said at least one bolt pass-through hole to complementally engage said door bolt and be received in said bolt hole;

an abutment device including housing adapted to move back and forth along said longitudinal slot and having a casing formed with an abutment side, said abutment housing being shiftable to an abutting position disposing said abutment for engagement with said door adjacent to said free edge, said abutment device including a plunger extending through said casing and having a retainer pin operative to engage said adjustment slot at selected locations along the length thereof to lock relative to said plate; and a spring in said housing engaging said plunger to bias it to an extended position engaging said pin with said slot for releasable engagement along the length of said plate to selectively lock said housing in selected positions on said plate.

* * * * *